United States Patent [19]

Matoba

[11] Patent Number: 4,600,158

[45] Date of Patent: Jul. 15, 1986

[54] RUNNER CHOPPER

[75] Inventor: Hideyasu Matoba, Osaka, Japan

[73] Assignee: Matex Co., Ltd., Osaka, Japan

[21] Appl. No.: 388,819

[22] Filed: Jun. 16, 1982

[30] Foreign Application Priority Data

Jun. 30, 1981 [JP] Japan ..... 56-101725

[51] Int. Cl.[4] ..... B02C 18/06

[52] U.S. Cl. ..... 241/243; 241/236

[58] Field of Search ..... 241/261, 293, 243, 292.1, 241/300.1, 294, 295, 241, 242, 88.4, 89.3, 236; 83/595, 596

[56] References Cited

U.S. PATENT DOCUMENTS

| | | | |
|---|---|---|---|
| 2,001,075 | 5/1935 | Sondstrand | 241/88.4 |
| 3,874,604 | 4/1975 | Gronberg et al. | 241/243 |
| 3,907,215 | 9/1975 | Mantelet | 241/88.4 |
| 3,991,944 | 11/1976 | Baikoff | 241/243 X |
| 4,009,838 | 3/1977 | Tashman | 241/236 X |
| 4,059,236 | 11/1977 | Brewer | 241/243 |
| 4,099,678 | 7/1978 | Brewer | 241/243 |
| 4,230,282 | 10/1980 | Haase | 241/236 X |

FOREIGN PATENT DOCUMENTS 1385970 3/1975 United Kingdom .

*Primary Examiner*—Howard N. Goldberg
*Assistant Examiner*—Joseph M. Gorski
*Attorney, Agent, or Firm*—Griffin, Branigan & Butler

[57] ABSTRACT

A runner chopper comprising in combination a driving device, a main shaft (1) that rotates slowly by the action of the driving device, several rotary blades (2) fitted around the main shaft with some distances therebetween, and the same number of fixed blades (3) as the rotary blades (2) which are fixed in the vicinity of the rotary blades (2) wherein either or both the rotary blades (2) and the fixed blades (3) have centripetal slanting edges which cause the inward movement of objects that are sandwiched between the rotary blades (2) and the fixed blades (3).

10 Claims, 6 Drawing Figures

2
37
36
33
34
32
35
θ
30
1
35
32
34
33
36
35
32
21
31
20
R
3

RUNNER CHOPPER

BACKGROUND OF THE INVENTION

This invention relates to a runner chopper.

When plastic products are manufactured by injection molding, runners of the plastic material are produced as a by-product.

A runner is a piece of plastic that is hardened in a channel or region connecting a nozzle of the injection molding machine with one of several cavities formed in a metal mold.

The plastic material in the runners can be reused by collecting the runners and supplying them to a crusher where they are broken into fine particles of plastic. Thus, the standard one-step crushing method converts runners directly into reusable plastic materials.

Though runners take various shapes according to the arrangement of cavities in a metal mold, they are normally long and bulky.

Because the elongate runners are fed directly into the crusher, the entrance to the crusher must be wide enough and the crusher must be long enough to accommodate them.

Moreover, because the crusher must smash the runners directly into fine particles, the blades of the crusher are rotated at high speed.

In the crusher a plurality of rotary blades are fitted around a main shaft which is rotated within a cylindrical casing of the crusher.

In a conventional crusher the plurality of rotary blades are fixed on the shaft without relative gaps between neighboring blades, and the gap between the casing and the blades is very narrow.

The runners are crushed and ground into fine particles in the narrow gap between the outer surfaces of the rotary blades and the inner surface of the casing by the shearing stresses generated by the rotation of the rotary blades. Thus the outer surface of the rotary blades provides the crushing force.

In order to rapidly crush the runners into fine particles, the rotary blades must be driven at high speed. Consequently, the crusher requires a substantial driving horsepower to overcome the large shear stresses and provide the high rotational speed.

In conventional runner crushers, the rotational speed is generally more than a thousand revolutions per minute and the driving power is between five to ten horsepower.

Unfortunuately, the conventional runner crushers are extremely noisy and produce large vibrations because of the high rotational speed and the necessary high driving force. These noises and vibrations are undesirable because they pollute the working environment and distress the worker.

Furthermore when a plastic molding machine is driven automatically overnight, plastic runners are conveyed into the runner crusher. The loud noise of the operating crusher becomes an incessant nuisance to neighbors, particularly at night. Consequently, it is desirable to suppress these nocturnal noises.

SUMMARY OF THE INVENTION

This invention seeks to solve the above difficulties.

In a preferred embodiment of the present invention a runner chopper comprises a driving device; a main shaft that rotates slowly by the action of the driving device; and, several rotary blades fitted around the main shaft with some distance therebetween. The same number of fixed blades as rotary blades are fixed in the vicinity of the rotary blades, wherein either or both of the rotary blades and the fixed blades have centripetal, cutting wells which cause inward movement of objects that are sandwiched between the rotary blades and the fixed blades.

The invention will be more fully understood from the following description given by way of example only with reference to the several figures of the accompanying drawings.

DETAILED DESCRIPTION OF DRAWINGS

Figure 1:
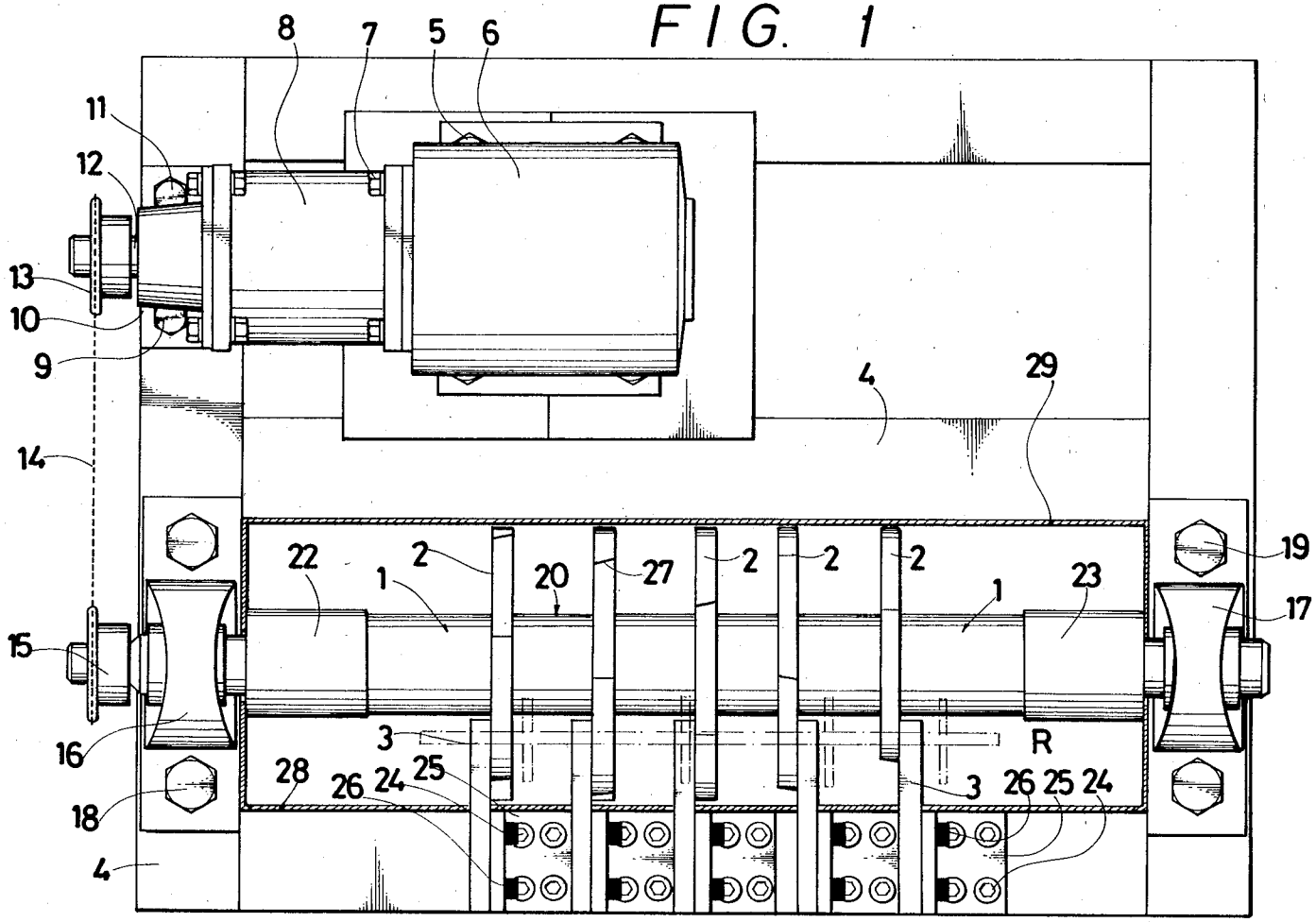
FIG. 1 is a plan view of a runner chopper as an embodiment of the invention with upper guide walls omitted.

Referring now to FIG. 1, a runner chopper has a main shaft 1 for rotation about a horizontal axis. A plurality of rotary blades 2 are secured to the main shaft 1 with a spacer 20 between each pair of blades 2. A number of fixed blades 3, equal to the number of rotary blades 2, are positioned each one adjacent to the side surface of one of the rotary blades 2.

A driving device drives the main shaft 1 at low speed. The driving device has a motor 6, a reduction gear 8, a chain 14 and two sprockets 13, 15.

The motor 6 is mounted on a horizontal table 4 by a plurality of bolts 5. The reduction gear 8 is secured to the front of the motor 6 by a plurality of bolts 7.

Figure 3:
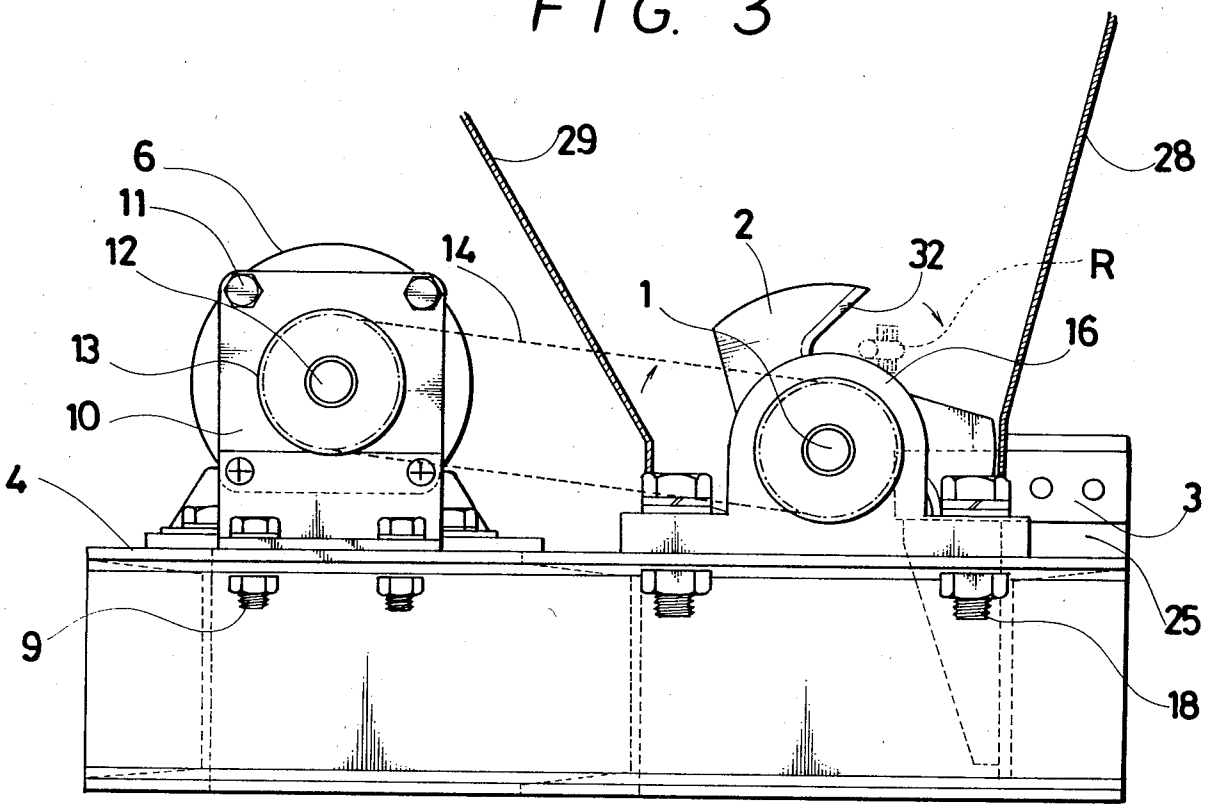
FIG. 3 is a left side view thereof.

As shown in FIG. 3, the front portion of the reduction gear 8 is secured by a plurality of bolts 11 to a vertical face of an L-shaped bracket 10. The bracket 10 is supported on the horizontal table 4 and secured in position by a plurality of bolts 9.

An output shaft 12 of the reduction gear 8 has the sprocket 13. The sprocket 13 and a sprocket 15 fitted on one end of the main shaft 1 carry a driving chain 14.

Figure 2:
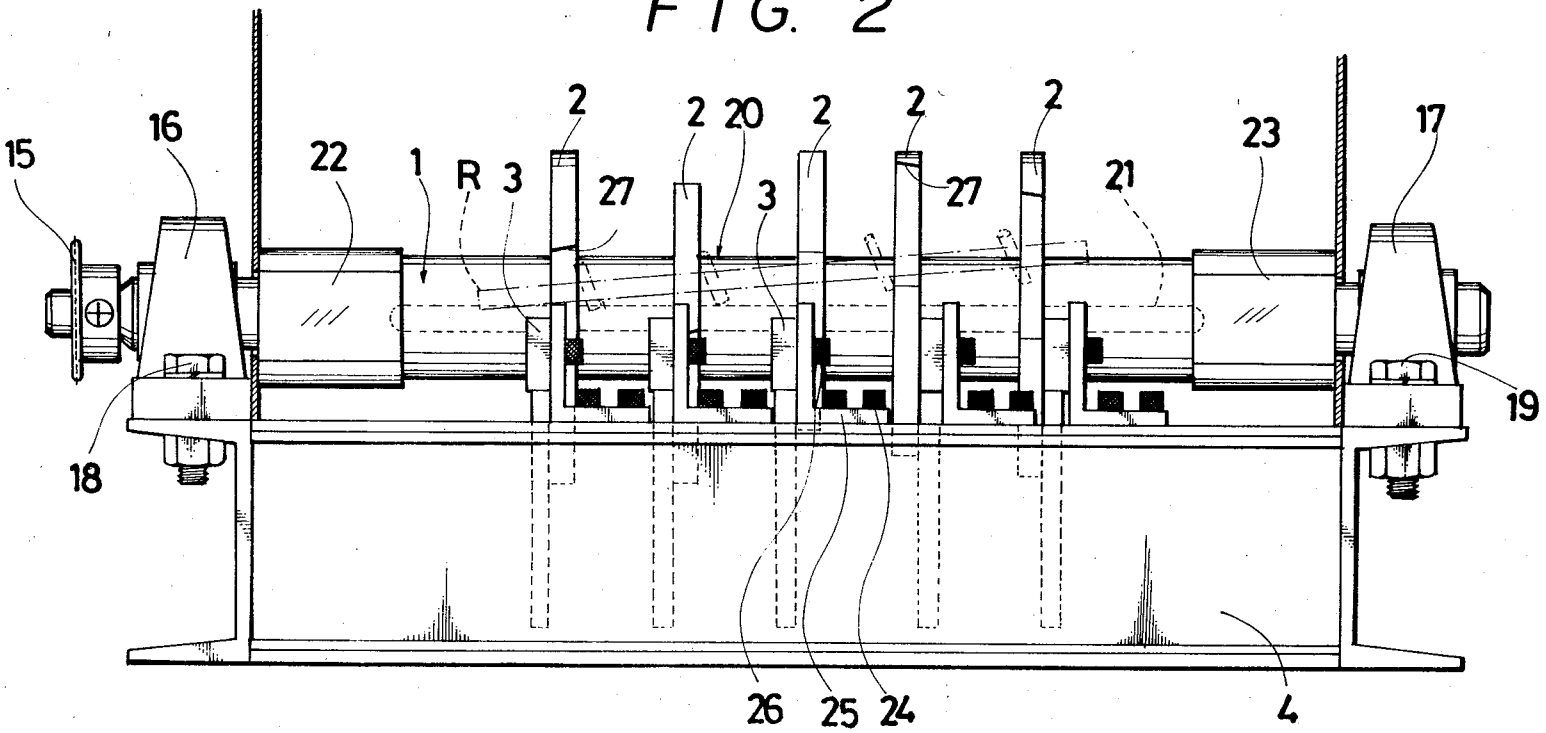
FIG. 2 is a front view of the runner chopper with the guide walls removed.

As can be seen in FIG. 2, the main shaft 1 is rotatively supported at its two ends by a pair of pillow blocks 16 and 17. The pillow blocks 16 and 17 are mounted on the table 4 by four bolts 18 and 19.

The rotary blades 2 and the spacers 20, installed on the main shaft 1, are pressed together by tightening two nuts 22 and 23 at the ends of the shaft 1.

Each fixed blade 3, is secured by a bracket 25 to the table 4 by a plurality of fixing screws 24 and 26. The fixed blades 3 as illustrated in FIGS. 1–4 are simple straight blades.

The rotary blades 2 and the fixed blades 3 are in close proximity to each other on their respective side surfaces. The rotary blades 2 are provided with a sharp slanted edge 27. Plastic runners are cut in the region where the rotary blade's sharp edge 27 comes into close contact with the fixed blade 3. The fixed blades 3 may also have sharp slanted edges.

Walls 28 and 29 are installed around the main shaft 1 to guide the plastic runners to the cutter blades 2 and 3.

Figure 4:
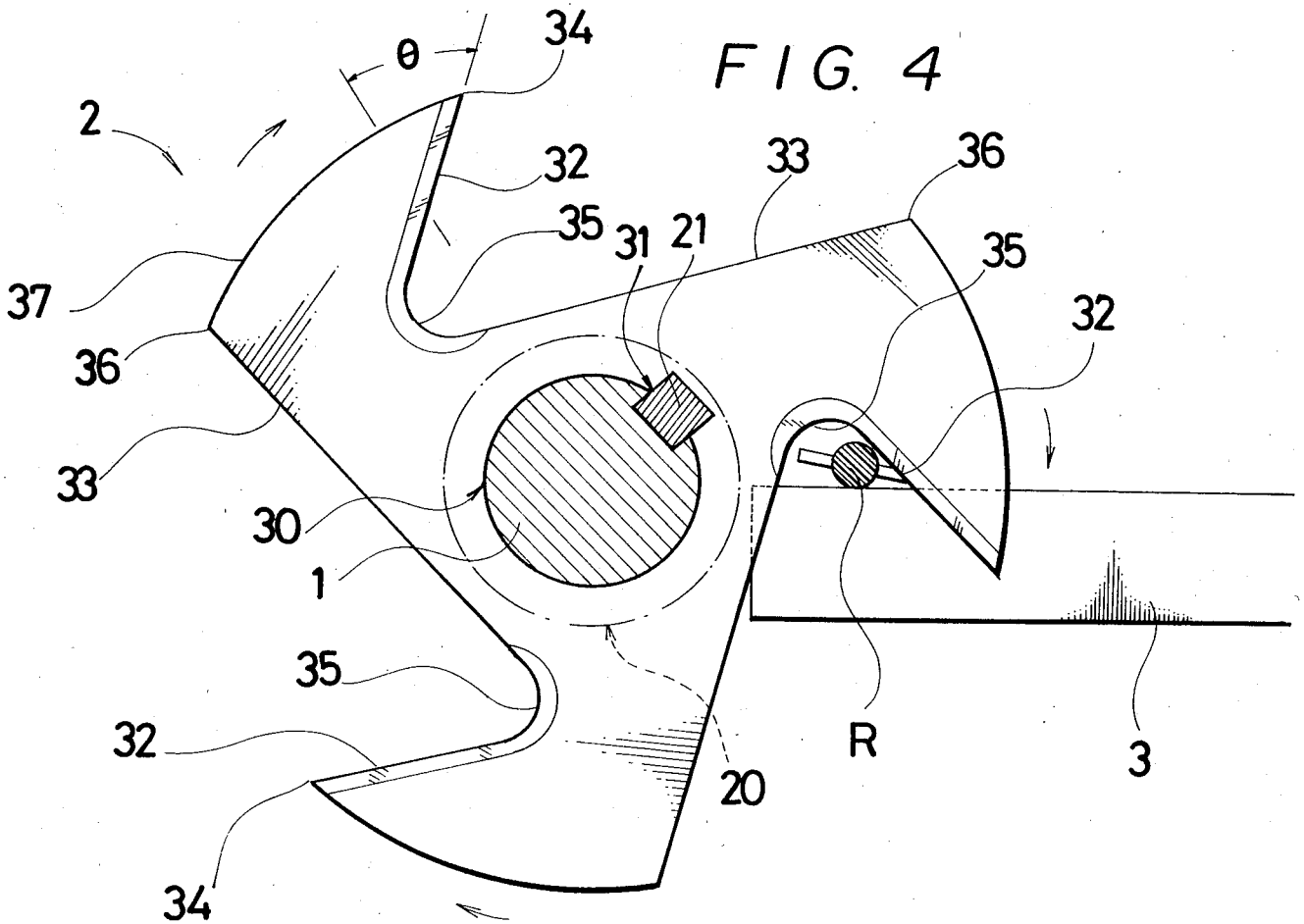
FIG. 4 is an enlarged side view of an embodiment of this invention.

As shown in FIG. 4, the rotary blade 2 rotates clockwise and possess three identical cutting portions with slanted sharp edges. The blade 2 has an axial central hole 30 and a key groove 31. A key 21 secures the blade 2 to the main shaft 1. A centripetal slant edge 32 for cutting plastic runners extends inwardly from the periphery of the rotary blade 2 to an arcuate cutting well edge 35. For purposes of this specification and claims, a "centripetal cutting well" is defined as a cutting edge which receives the inward movement of objects sandwiched between the rotary blades 2 and the fixed blades 3.

The rear of each cutting portion of the blade 2 is an oblique blunt surface 33 which forms an acute angle with the centripetal slant edge 32 extended.

The centripetal slant edge 32, which spans from a top claw 34 to the inner cutting well 35, pulls any object deposited thereupon inwardly, as the rotary blade 2 rotates.

The centripetal slant edge 32 forms an acute angle $\theta$ with a radial line from the center of the rotary blade 2 and pulls an object inwardly against the centrifugal force.

The average pulling angle is 45 degrees of arc in the embodiment shown in FIG. 4.

Elongate plastic runners are pulled inwardly by the centripetal slant edge 32 and chopped by bottom cutting well 35 and the fixed blades 3.

A top point 36; a peripheral round surface 37 of the rotary blade 2; and the oblique blunt surface 33, connect adjacent centripetal slant edges 32, but do not contribute to chopping of the plastic runners.

The rotary blades 2 are attached with some phase differences around the main shaft 1. If five rotary blades each with three cutting portions are used, as in this example, the blades are phased apart 24 degrees in rotation about the shaft 1.

In the general case when the rotary blades have m symmetrical cutting portions and the main shaft has n rotary blades, the best phase shift $\Psi$ of the rotary blades 2 about the shaft 1 is determined by:

$$\Psi = \frac{360°}{n\,m}$$

The rotary blades 2 are fixed at thirty to forty millimeters distance around the main shaft 1 and the phases of the rotary blades vary randomly by twenty four degrees of arc. That is, the phase shifts of the rotary blades 2 are not necessarily done in sequence from one side to the other side of the main shaft 1. It is preferable to vary the phases of the rotary blades 2 at random.

The main shaft 1 rotates at low speed. An adequate rotational speed is from one to fifteen revolutions per minute. In the above embodiment of the invention the rotational speed of the main shaft 1 is only three revolutions per minute.

The rotational speed of the motor 6 is 1800 revolutions per minute, the reduction gear 8 has a ratio of 500 to 1 and the sprocket pair 13 and 15 again reduces the rotation of the shaft slightly.

Plastic runners generally comprise an elongate trunk and several branches, though they may take various shapes according to the arrangements of the mold.

The runner chopper of this invention is conveniently installed near a plastic injection molding machine. The injection molding machine ejects a runner as an elementary molding cycle is completed. The plastic runners are carried upward by a conveyor and supplied into the guide walls 28 and 29.

After entering through the guide walls 28 and 29, the plastic runners ride on the rotary blades 2, and the runner trunks are carried almost parallel with the main shaft 1.

When the rotary blades 2 rotate slowly a runner R as shown in FIG. 4 is sandwiched between and pulled inward by the centripetal slant edges 32 of the rotary blades 2 and the fixed blades 3. Then the runner R is chopped by the interaction between the bottom cutting wells 35 and the fixed blades 3.

With a minimum of elapsed time, the rotary blades 2 chop the runner R into several pieces. The chopped pieces fall downwardly into a receptacle (not shown) placed below the chopper. As the chopped pieces stored in the receptacle reach a certain amount, the stored pieces are supplied into a conventional runner crusher (not shown in Figures), in which the runner pieces are crushed into fine particles.

In a conventional recycling method, plastic runners are supplied and completely crushed in a single runner crusher apparatus. Because plastic runners are generally bulky and elongate, the crusher used in the conventional method must be a powerful crusher with a wide inlet and a long main shaft having many rotary blades. In the runner chopper of this invention, however, runners are not sheared by the outer surfaces of rotary blades like conventional crushers, but are chopped by the inner bottom cutting wells 35 of the rotary blades 2 interacting with the fixed blades 3.

By positioning the runner chopper of this invention to precede a crusher in the recycling process of runners, small chopped runner pieces are supplied into the crusher. Thus, a smaller crusher with a lesser power requirement can be used. Therefore, this invention is very useful in overcomming the objectionable noise and power requirements of conventional crushers.

This invention also employs the unique technique of cutting runners by the interaction between inner portions of the rotary blades and the fixed blades.

Figure 5:
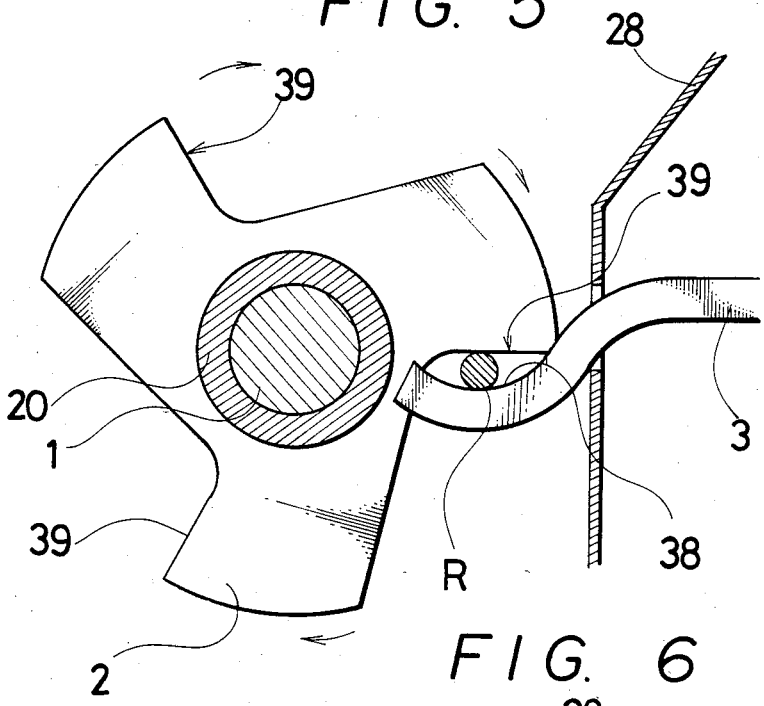
FIG. 5 is enlarged side view of another embodiment of this invention.

In another embodiment centripetal slant edges are used on the fixed blades to push objects inwardly as they rotate. Such an embodiment is shown in FIG. 5. The fixed blade 3 has a centripetal cutting well 38, but the rotary blade 2 has a simple flat edge 39 nearly radial. The centripetal cutting well 38 pushes a runner inwardly as the rotary blade 2 rotates clockwise as can be seen in FIG. 5.

Figure 6:
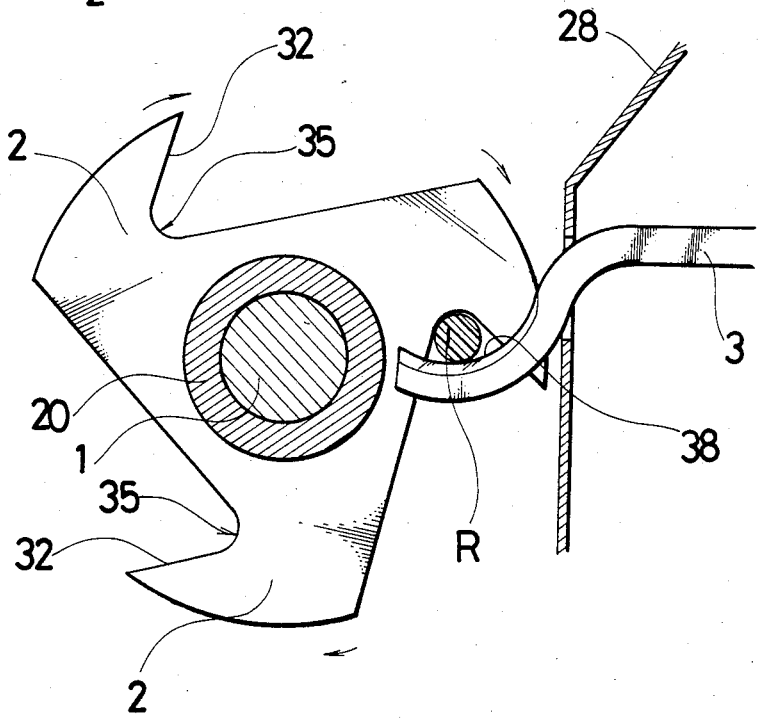
FIG. 6 is enlarged side view of still another embodiment of this invention.

In another embodiment as illustrated in FIG. 6, the rotary blade 2 has a centripetal cutting well 35 and the fixed blade 3 also has a centripetal cutting well 38. Consequently, either or both the rotary blades 2 and the fixed blades 3 have centripetal slant edges which cause the inward movement of the runner sandwiched between them as the rotary blades rotate.

The rotational speed of the main shaft 1 may be established to accomodate the molding cycle of the injection molding machine. In general if the rotation speed is less than one revolution per minute, there is a possibility that two runners may be chopped at the same time in the chopper. On the other hand, the rotation speed need not exceed thirty revolutions per minute, because the molding cycle of injection molding machines is generally several times longer than the chopping cycle of the runner chopper. Thus the optimum range for the rotation speed of the rotary blades in this invention is from one to fifteen revolutions per minute.

The embodiments of the invention in which an exclusive property or privilege is claimed are defined by the following:

1. A motor-driven rotary chopper aparatus for cutting plastic runners, comprising:

a plurality of rotary blades n in number mounted on a rotating driven shaft and separated axially on said driven shaft, wherein said driven shaft rotates slowly so that the apparatus runs quietly;

cutting means m in number on each of said rotary blades, each cutting means having a centripetal cutting well wherein a positioning phase angle of separation of each of said cutting means around said driven shaft is in accordance with the formula $360°/(m)\times(n)$ so that only one of said cutting means cuts one runner at a time; and, a plurality of separated fixed blades positioned adjacent to said rotary blades to provide a plurality of cutting areas with said centripetal cutting wells of said rotary blades thereby forcing an object sandwiched between said rotary blades and said fixed blades into said cutting wells, said separated rotary blades and said separated fixed blades interacting together at interaction cutting areas and providing a plurality of axial non-cutting gaps between the interaction cutting areas so that a runner that has been cut between adjacent rotary blades will fall into the non-cutting gap between the adjacent rotary blades.

2. The rotary runner chopper of claim 1, further comprising:

a centripetal cutting well on each of said fixed blades which interacts with said centripetal cutting well of a said rotary blade.

3. The rotary runner chopper of claim 1, wherein the number of said cutting means is three per said rotary blade and the number of said rotary blades is five and the phase angle of separation of said cutting means between different blades is 24 degrees.

4. The rotary runner chopper of claims 1 or 2 wherein said slowly rotating driven shaft rotates at fifteen revolutions per minute.

5. The rotary runner chopper of claims 1 or 2 wherein said slowly rotating driven shaft rotates at less than fifteen revolutions per minute.

6. A motor-driven rotary chopper apparatus for cutting plastic runners, comprising:

a plurality of rotary blades n in number mounted on a rotating driven shaft and separated axially on said driven shaft; wherein said driven shaft rotates slowly so that the apparatus runs quietly;

cutting means m in number on each of said rotary blades, each cutting means having a centripetal cutting well wherein a positioning phase angle of separation of each of said cutting means around said driven shaft is in accordance with the formula $360°/(m)\times(n)$ so that only one of said cutting means cuts a runner at a time; and, a plurality of separated fixed blades adjacent to said rotary blades each with a centripetal cutting well positioned to interact with said cutting means of said rotary blades thusly forcing an object sandwiched between said fixed blade and said rotary blade into said cutting wells, said separated rotary blades interacting together at interaction cutting areas and providing a plurality of axial non-cutting gaps between the interaction cutting areas so that a runner that has been cut between adjacent rotary blades will fall into the non-cutting gap between the adjacent rotary blades.

7. The rotary runner chopper of claim 6 further comprising:

a centripetal slanting edge on each of said cutting means on said rotary blades which interacts with said centripetal cutting well of said fixed blade.

8. The rotary runner chopper of claim 6 or 7 wherein the number of cutting means is three per said rotary blade and the number of said rotary blades is five and the phase angle of separation of said cutting means between different blades is 24 degrees.

9. The rotary runner chopper of claims 6 or 7 wherein said slowly rotating driven shaft rotates at fifteen revolutions per minute.

10. The rotary runner chopper of claims 6 or 7 wherein said slowly rotating driven shaft rotates at less than fifteen revolutions per minute.

* * * * *